US007686981B1

(12) United States Patent
Yang et al.

(10) Patent No.: US 7,686,981 B1
(45) Date of Patent: Mar. 30, 2010

(54) DISPERSIONS OF CONDUCTIVE CARBON MATERIALS AND METHODS FOR PREPARING THE SAME

(75) Inventors: Chan-Yi Yang, Tu-Chen (TW); Jui-Sheng Lee, Taipei (TW)

(73) Assignee: Taiwan Textile Research Institute, Taipei Hsien (TW)

( * ) Notice: Subject to any disclaimer, the term of this patent is extended or adjusted under 35 U.S.C. 154(b) by 0 days.

(21) Appl. No.: 12/346,801

(22) Filed: Dec. 30, 2008

(30) Foreign Application Priority Data

Dec. 19, 2008 (TW) ..... 97149813 A

(51) Int. Cl.
*H01B 1/24* (2006.01)

(52) U.S. Cl. ..... 252/510

(58) Field of Classification Search ..... 252/510
See application file for complete search history.

(56) References Cited

U.S. PATENT DOCUMENTS 4,301,067 A * 11/1981 Koshugi ..... 536/20
5,229,504 A * 7/1993 Hayashi ..... 536/20
5,454,907 A * 10/1995 Hayashi ..... 162/26
5,651,814 A * 7/1997 Shimomura et al. ..... 106/31.36
5,698,185 A * 12/1997 Itagaki et al. ..... 424/62
6,723,402 B2 * 4/2004 Nair et al. ..... 428/35.7
6,929,362 B2 * 8/2005 Takada et al. ..... 347/100
7,058,272 B2 * 6/2006 Bourdelais et al. ..... 385/129
7,198,837 B1 * 4/2007 Endo et al. ..... 428/195.1
2002/0077386 A1 * 6/2002 Kurabayashi et al. ..... 523/161
2002/0097290 A1 * 7/2002 Koitabashi et al. ..... 347/16
2003/0124452 A1 * 7/2003 Nair et al. ..... 430/264
2004/0125185 A1 * 7/2004 Takada et al. ..... 347/100
2005/0106211 A1 * 5/2005 Nelson et al. ..... 424/423
2005/0147372 A1 * 7/2005 Bourdelais et al. ..... 385/129
2006/0025583 A1 * 2/2006 Wei et al. ..... 536/54
2006/0198786 A1 * 9/2006 Wei et al. ..... 424/1.69
2007/0131546 A1 * 6/2007 Nomoto et al. ..... 204/403.01
2008/0152827 A1 * 6/2008 Hakamada et al. ..... 427/466
2008/0220030 A1 * 9/2008 Alonso Fernandez et al. ..... 424/401
2009/0074824 A1 * 3/2009 Vila Pena et al. ..... 424/401

* cited by examiner

*Primary Examiner*—Douglas MC Ginty
(74) *Attorney, Agent, or Firm*—Rabin & Berdo, P.C.

(57) ABSTRACT

A method for preparing a dispersion of conductive carbon materials is provided. The method includes dissolving a sulfonated chitosan in an aqueous solution, wherein the amount of the sulfonated chitosan of the solution is about 0.1-3 wt %. Then, a conductive carbon material is added into the solution, and the conductive carbon material in the solution is dispersed across the solution. The conductive carbon material can be carbon black or carbon nanotube.

19 Claims, 4 Drawing Sheets

Day1

Day 30

Day 42

Day 1

Day 35

Day 42

Day 1

Day 56

DISPERSIONS OF CONDUCTIVE CARBON MATERIALS AND METHODS FOR PREPARING THE SAME

RELATED APPLICATIONS

This application claims priority to Taiwan Application Serial Number 97149813, filed Dec. 19, 2008, which is herein incorporated by reference.

BACKGROUND

1. Field of Invention

The present invention relates to dispersions of conductive carbon material and method for preparing the same. More particularly, the present invention relates to carbon black dispersion and carbon nanotube dispersion and method for preparing the same.

2. Description of Related Art

There are several allotropes of carbon of which the best known are graphite, diamond, and amorphous carbon. The physical properties of carbon vary widely with the allotropic form. For example, diamond is highly transparent, while graphite is opaque and black. Diamond is among the hardest materials known, while graphite or carbon black is soft enough to form a streak on paper. Diamond has a very low electrical conductivity, while graphite or carbon black is a very good conductor.

Accordingly, carbon black is used as filler in rubber products; thereby the rubber products may act as antistatic material. Moreover, carbon black is also used as filler in electrodes of methanol fuel cell; thereby the electrodes have a very good electrical conductivity.

Many believe that carbon nanotube is discovered in 1991 is of particular importance because it brought carbon nanotubes into the awareness of the scientific community as a whole. Carbon nanotubes (CNTs) are allotropes of carbon with a nanostructure that can have an aspect ratio greater than 10,000,000 and as high as 40,000,000. These cylindrical carbon molecules have novel properties that make them potentially useful in many applications in nanotechnology, electronics, optics and other fields of materials science, as well as potential uses in architectural fields. They exhibit extraordinary strength and unique electrical properties, and are efficient conductors of heat.

Based upon experience, conductive carbon materials shall disperses to form suspension or dispersion, without respect to carbon nanotube or carbon black. However, it is difficult to make a solution of these conductive carbon is materials served as suspension or dispersion; alternatively, the suspension or dispersion is unstable.

In view of the foregoing, there is a need for a new dispersion of conductive carbon materials and method for preparing the same. The present disclosure meets this need.

SUMMARY

In one aspect, the present invention is directed to a method for preparing a dispersion of a conductive carbon material that requires less steps and less ingredients than the prior art does and thus can reduce the manufacturing cost.

According to one embodiment of the present invention a, the method for preparing the dispersion of the conductive carbon material includes the following procedure. First, sulfonated chitosan is dissolved in an aqueous solvent to obtain a 0.1-3 wt % solution of sulfonated chitosan. Then, a conductive carbon material is added into the sulfonated chitosan solution and then dispersed evenly therein to obtain the dispersion of the conductive carbon material.

In different embodiments of the present invention, said conductive carbon material can be carbon black or carbon nanotube.

In another aspect, the present invention is directed to a dispersion of a conductive carbon material that exhibits better stability and has higher dispersion concentration.

According to one embodiment of the present invention a, the dispersion of the conductive carbon material consists essentially of: 0.1-3 wt % sulfonated chitosan, conductive carbon material, and an aqueous solvent.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
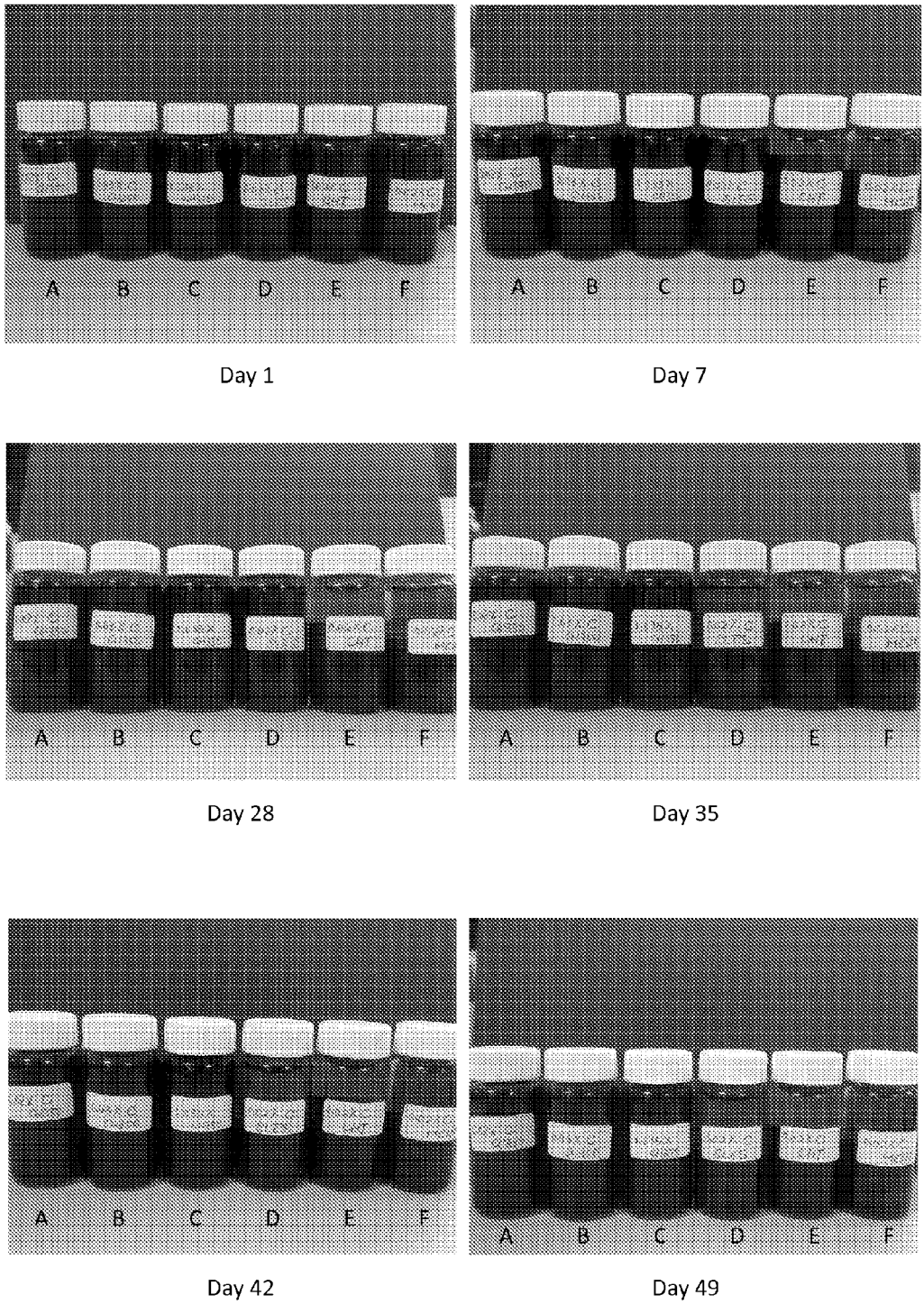
FIG. 1 shows photographs of the dispersions according to Experiment (I) of the present invention.

Reference will now be made in detail to the present embodiments of the invention. First, embodiments for preparing the dispersion of the conductive carbon material as well as preparation examples thereof are illustrated. Moreover, foaming property, viscosity, and dispersion stability of the resultant dispersions are also investigated.

Generally, aid agents such as dispersing agent, stabilizer, film-forming agent, thickening agent, and deforming agent are required during the preparation of the dispersion of conductive carbon material. The addition of these and other aid agents renders the preparation procedure both complicated and time-consuming. Moreover, some aid agents might alter the photoelectrical property of the conductive material in an unwanted way.

Therefore, in one aspect, the present invention is directed to a method for preparing a dispersion of a conductive carbon material.

According to one embodiment of the present invention a, the method for preparing the dispersion of the conductive carbon material includes the following procedure. First, sulfonated chitosan is dissolved in an aqueous solvent to obtain a 0.1-3 wt % solution of sulfonated chitosan. Then, a conductive carbon material is added into the sulfonated chitosan solution and then dispersed evenly therein to obtain the dispersion of the conductive carbon material.

According to one embodiment of the present invention, said sulfonated chitosan is N-sulfonated chitosan.

According to the above embodiments, the height of the foam occurring in the sulfonated chitosan solution is 0 cm. In other words, there is almost no foam generated during the preparation procedure and thus no defoaming agent is required in the above-mentioned method.

Moreover, according to the above embodiments, the viscosity of the sulfonated chitosan solution is about 32-35 cP and no thickening agent is required in the above-mentioned method.

In some embodiments of the present invention, said conductive carbon material can be carbon black. According to embodiments of the present invention, the weight percent of carbon black in the dispersion of the conductive carbon material is about 0.02-0.035%.

In other embodiments of the present invention, said conductive carbon material can be carbon nanotube. According to embodiments of the present invention, the weight percent of carbon nanotube in the dispersion of the conductive carbon material is at most about 25.0%. According to some embodiments of the present invention, the weight percent of carbon nanotube in the dispersion of the conductive carbon material is about 0.5-12.5%. According to embodiments of the present invention, said carbon nanotube can be single-walled carbon nanotube or double-walled carbon nanotube.

In another aspect, the present invention is directed to a dispersion of a conductive carbon material that exhibits better stability and has higher dispersion concentration. Said dispersion of a conductive carbon material is prepared in accordance with the method of the embodiments of the present invention. According to the experimental results showed below, some of the dispersions of the present invention show no settling after 45 days. In some examples, the dispersion concentration of the conductive carbon material in the dispersion can be at most about 25 wt %.

According to one embodiment of the present invention a, the dispersion of the conductive carbon material consists essentially of: 0.1-3 wt % sulfonated chitosan, conductive carbon material, and an aqueous solvent.

According to one embodiment of the present invention, said sulfonated chitosan is N-sulfonated chitosan.

According to the above embodiments, the height of the foam occurring in the sulfonated chitosan solution is 0 cm. According to the above embodiments, the viscosity of the sulfonated chitosan solution is about 32-35 cP.

In some embodiments of the present invention, said conductive carbon material can be carbon black. According to embodiments of the present invention, the weight percent of carbon black in the dispersion of the conductive carbon material is about 0.02-0.035%.

In other embodiments of the present invention, said conductive carbon material can be carbon nanotube. According to embodiments of the present invention, the weight percent of carbon nanotube in the dispersion of the conductive carbon material is at most about 25.0%. According to some embodiments of the present invention, the weight percent of carbon nanotube in the dispersion of the conductive carbon material is about 0.5-12.5%. According to embodiments of the present invention, said carbon nanotube can be single-walled carbon nanotube or double-walled carbon nanotube.

Preparation examples and comparative examples are described to further illustrate the dispersion concentration and dispersion stability of the dispersions of the present invention.

In the following preparation examples, sulfonated chitosan was used to disperse conductive carbon material according to embodiments of the present invention. With respect to the comparative examples, sodium lauryl ether sulfate (SLES), chitosan, and carboxymethyl chitosan were used to disperse conductive carbon material.

The dispersion samples were allowed to stand still at room temperature (about 23-27° C.) for at least 49 days. The dispersion samples were examined each day to see if settling of particles appeared and the results were recorded. As will occur to those with ordinary skill in the art, settling time is related to the dispersion stability. Generally, longer settling time means better dispersion stability.

Experiment (I)

Carbon Black Dispersion Concentration and Stability

In this series of experiments, about 0.1 wt % solution of sulfonated chitosan was prepared according to the embodiments of the present invention. Then, about 4 mg, about 6 mg, and about 7 mg of carbon black were added to 20 mL of said sulfonated chitosan solution, respectively. The solution thus obtained was stirred with a homogenizer at a speed of about 400 rpm for about 30 minutes to obtain the carbon black dispersion. The resultant carbon black dispersion samples were allowed to stand still for at least 49 days and the states of the samples were recorded each day. Samples of comparative examples were prepared in accordance with the above-mentioned procedure except the dispersing agents used were different. Selected photographs of the samples taken on different days were shown in FIG. 1 and the results were summarized in table 1.

TABLE 1

| Carbon Black (wt %) | Dispersing agent | Settling Time (day) | Sample |
|---|---|---|---|
| 0.02 | Sulfonated chitosan | >49 | A |
| | SLES | 28-35 | D |
| | Carboxymethyl chitosan | 1-7 | F |
| | Chitosan | 1-7 | E |
| 0.03 | Sulfonated chitosan | >49 | B |
| 0.035 | Sulfonated chitosan | >49 | C |

It is apparent from table 1 and FIG. 1 that dispersions with better dispersion stability could be obtained with the dispersing agent provided by the embodiments of the present invention. More specifically, according to samples A-C, dispersions with about 0.1 wt % sulfonated chitosan could disperse about 0.02-0.035 wt % carbon black. Besides, the resultant carbon black dispersions showed no sign of settling occurred for at least 49 days.

On the other hand, with respect to chitosan used in sample E and carboxymethyl chitosan used in sample F, settling occurred within 1 week. is Referring to photographs shown in FIG. 1, on day 7, apparent phase separation could be observed in sample E and sample F. Moreover, still referring to photographs shown in FIG. 1, with respect to SLES used in sample D, settling occurred at Day 28 and apparent phase separation can be observed at Day 35.

Experiment (II)

Carbon Nanotube Dispersion Concentration and Stability

In this series of experiments, about 0.1 wt % solution of sulfonated chitosan was prepared according to the embodiments of the present invention. Then, carbon nanotubes of about 100 mg to about 10 g were added to 20 mL of said sulfonated chitosan solution, respectively. The solution thus obtained was vibrated with an ultrasonic vibrator for about one hour to obtain the carbon nanotube dispersion. The resultant carbon nanotube dispersion samples were allowed to stand still for at least 49 days and the states of the samples were recorded each day. Samples of comparative examples were prepared in accordance with the above-mentioned procedure except the dispersing agents used were different. Selected photographs of the samples taken on different days were shown in FIG. 2 and FIG. 3, and the results were summarized in table 2.

TABLE 2

| carbon nanotube (wt %) | Dispersing agent | Settling Time (day) | Sample |
|---|---|---|---|
| 0.5 | sulfonated chitosan | >45 | 2 |
| | SLES | 1 | 4 |
| | carboxymethyl chitosan | 1 | 3 |
| | chitosan | 1 | 1 |
| 1.0 | sulfonated chitosan | >45 | 5 |
| 2.5 | sulfonated chitosan | >45 | 6 |
| 5.0 | sulfonated chitosan | 42 | 7 |
| 7.5 | sulfonated chitosan | 42 | 8 |
| 10.0 | sulfonated chitosan | 42 | 9 |
| 12.5 | sulfonated chitosan | 35 | 10 |
| 20.0 | sulfonated chitosan | 35 | 11 |
| 25.0 | sulfonated chitosan | 35 | 12 |
| 37.5 | sulfonated chitosan | 7 | 13 |
| 50 | sulfonated chitosan | 7 | 14 |

Figure 2:
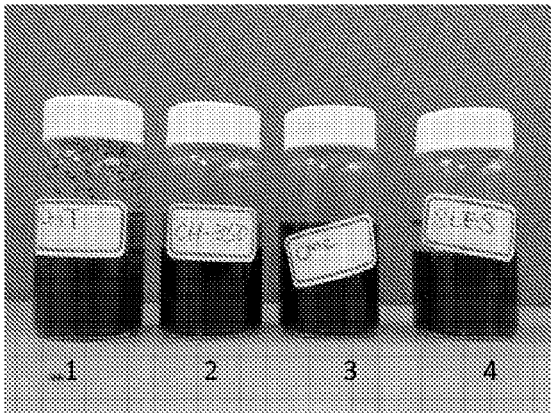
FIGS. 2-4 show photographs of the dispersions according to Experiment (II) of the present invention.
Figure 2:
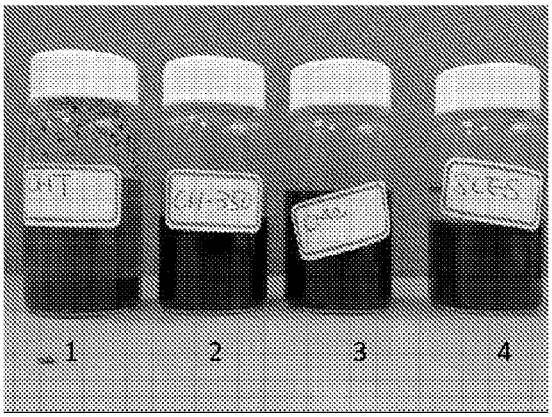
Figure 2:
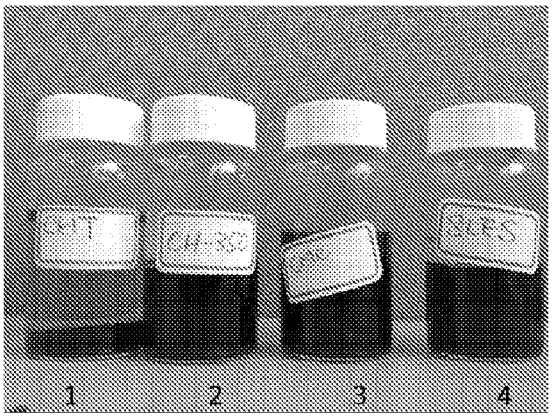

It is apparent from table 2 and FIG. 2 that SLES (sample 4), chitosan (sample 1), or carboxymethyl chitosan (sample 3) are not suitable dispersing agents for carbon nanotube for they could not effectively disperse small amount (5 wt %) of carbon nanotube.

Figure 3:
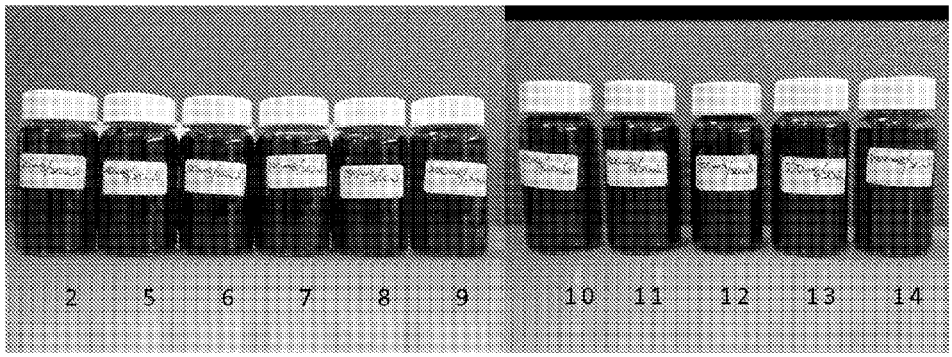
Figure 3:
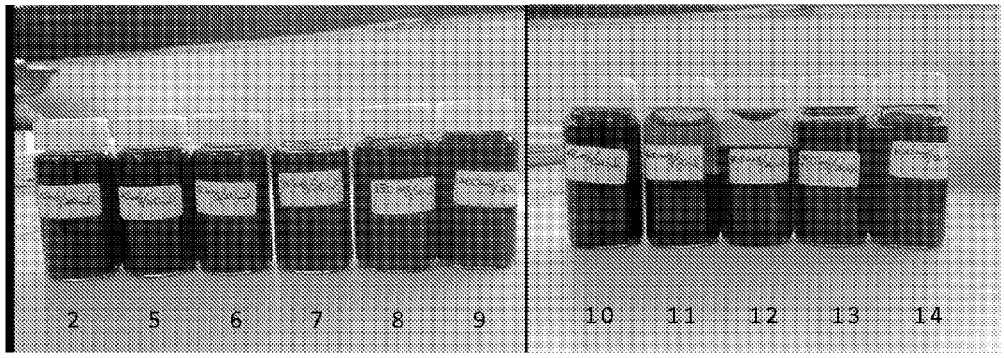
Figure 3:
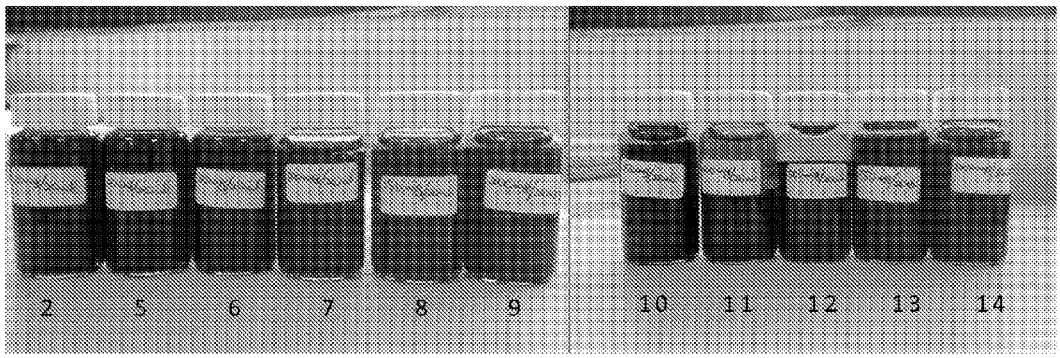

As can be seen in table 2 and FIG. 3, dispersions with better dispersion stability could be obtained with the dispersing agent provided by the embodiments of the present invention. According to sample 2 and samples 5-12, dispersions with about 0.1 wt % sulfonated chitosan could disperse about 0.5-25 wt % carbon nanotube and the dispersions can be store for at least a month. More specifically, when the weight percent of carbon nanotube is about 0.5-2.5% (samples 2, 5, 6), no sign of settling occurred for at least 45 days; when the weight percent of carbon nanotube is about 5-10% (samples 7-9), settlement of carbon nanotubes took place at Day 42; and when the is weight percent of carbon nanotube is about 12.5-25% (samples 10-12), settlement of carbon nanotubes took place at Day 35.

Referring to table 2, it can be appreciated that the dispersing agent according to embodiments the present invention, has better dispersion dispersibility than the dispersing agents of comparative embodiments do.

Experiment (III)

Dispersibility of 3 wt % Solution of Sulfonated Chitosan

In this series of experiments, about 3 wt % solution of sulfonated chitosan was prepared according to the embodiments of the present invention. Then, carbon black and carbon nanotubes of different weights were added to 20 mL of said sulfonated chitosan solution, respectively. The solution thus obtained was vibrated with an ultrasonic vibrator for about one hour to obtain the dispersion. The resultant dispersion samples were allowed to stand still for at least 56 days and the states of the samples were recorded each day. Selected photographs of the samples taken on different days were shown in FIG. 4, and the results were summarized in table 3.

TABLE 3

| Conductive Carbon Material (wt %) | Settling Time (day) | Sample |
|---|---|---|
| carbon black 0.035 wt % | >56 | 15 |
| carbon nanotube 12.5 wt % | >56 | 16 |
| carbon nanotube 25 wt % | >56 | 17 |

Figure 4:
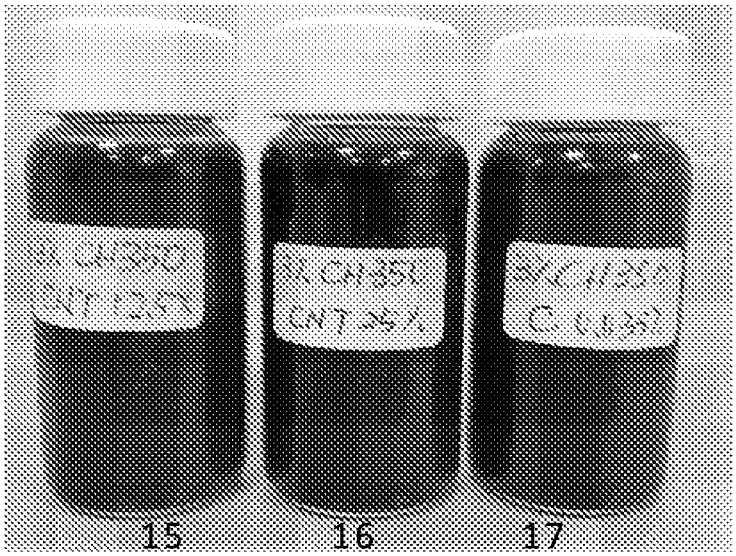
Figure 4:
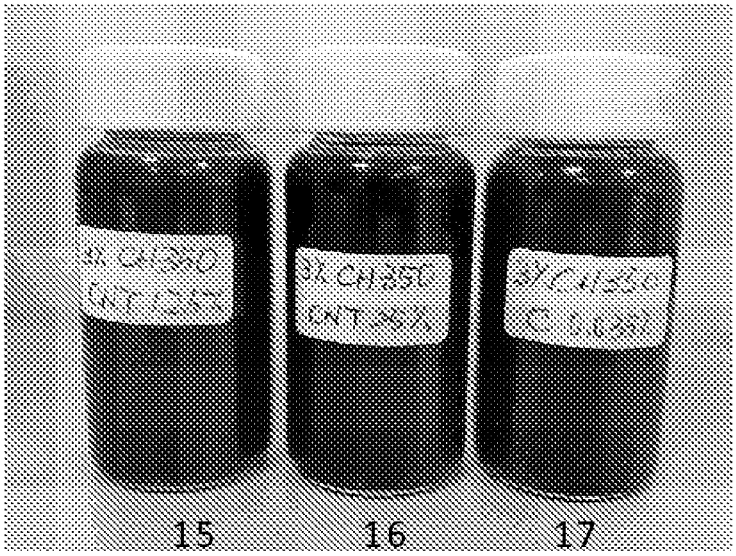

As can be seen in table 3 and FIG. 4, dispersions of samples 15-17 showed no sign of settling occurs for at least 56 days. By comparing data shown in table 2 and table 3, it is appreciated that the stability and dispersibility of dispersion might be affected by the concentration of solution of sulfonated chitosan. Specifically, sample 10 was prepared with about 0.1 wt % solution of sulfonated chitosan while sample 16 was prepared with about 3 wt % solution of sulfonated chitosan and both samples 10 and 16 had a carbon nanotube content of about 12.5 wt %. The results of observation showed that with respect to sample 10, settlement of carbon nanotubes took place at Day 35 while no sign of settling occurred for at least 56 days.

From the above-described experiments and results, it is appreciated that the dispersion of conductive carbon material according to embodiments of the present invention excels in dispersion dispersibility and dispersion stability, Besides, the method for preparing the dispersion of conductive carbon material is much simpler than prior art. Also, the ingredients required according to the method of the present invention are less than prior art.

It will be apparent to those skilled in the art that various modifications and variations can be made to the structure of the present invention without departing from the scope and spirit of the invention. In view of the foregoing, it is intended that the present invention cover modifications and variations of this invention provided that they fall within the scope of the appended claims.

What is claimed is:

1. A method for preparing a dispersion of a conductive carbon material, comprising:

dissolving sulfonated chitosan in an aqueous solvent to obtain a 0.1-3 wt % solution of sulfonated chitosan;

adding a conductive carbon material into the solution of sulfonated chitosan; and dispersing the conductive carbon material in the solution of sulfonated chitosan to obtain the dispersion of the conductive carbon material.

2. The method for preparing a dispersion of a conductive carbon material of claim 1, wherein the sulfonated chitosan is N-sulfonated chitosan.

3. The method for preparing a dispersion of a conductive carbon material is of claim 1, wherein the conductive carbon material is carbon black and the weight percent of the carbon black in the dispersion of the conductive carbon material is about 0.02-0.035%.

4. The method for preparing a dispersion of a conductive carbon material of claim 1, wherein the conductive carbon material is carbon nanotube and the weight percent of the carbon nanotube in the dispersion of the conductive carbon material is about 25.0%.

5. The method for preparing a dispersion of a conductive carbon material of claim 4, wherein the weight percent of the carbon nanotube in the dispersion of the conductive carbon material is about 0.5-12.5%.

6. The method for preparing a dispersion of a conductive carbon material of claim 4, wherein the carbon nanotube is single-walled carbon nanotube or double-walled carbon nanotube.

7. The method for preparing a dispersion of a conductive carbon material of claim 1, wherein a height of the foam occurring in the solution of sulfonated chitosan is 0 cm.

8. The method for preparing a dispersion of a conductive carbon material of claim 1, wherein a viscosity of the solution of sulfonated chitosan is about is 32-35 cP.

9. The method for preparing a dispersion of a conductive carbon material of claim 1, wherein the step of dispersing is carried out by dispersing with an ultrasonic vibrator for about one hour.

10. The method for preparing a dispersion of a conductive carbon material of claim 1, wherein the step of dispersing is carried out by dispersing with a homogenizer at a speed of about 400 rpm for about 30 minutes.

11. A dispersion of a conductive carbon material, consisting essentially 0.1-3 wt % sulfonated chitosan;

conductive carbon material; and an aqueous solvent.

12. The dispersion of a conductive carbon material of claim 11, wherein the sulfonated chitosan is N-sulfonated chitosan.

13. The dispersion of a conductive carbon material of claim 11, wherein the conductive carbon material is carbon black, and the weight percent of the carbon black in the dispersion of the conductive carbon material is about 0.02-0.035%.

14. The dispersion of a conductive carbon material of claim 11, wherein the conductive carbon material is carbon nanotube, and the weight percent of the carbon nanotube in the dispersion of the conductive carbon material is at most about 25.0%.

15. The dispersion of a conductive carbon material of claim 14, wherein the weight percent of the carbon nanotube in the dispersion of the conductive carbon material is about 0.5-12.5%.

16. The dispersion of a conductive carbon material of claim 14, wherein the carbon nanotube is single-walled carbon nanotube or double-walled carbon nanotube.

17. The dispersion of a conductive carbon material of claim 11, wherein a height of the foam occurring in the solution of sulfonated chitosan is 0 cm.

18. The dispersion of a conductive carbon material of claim 11, wherein a viscosity of the solution of sulfonated chitosan is about 32-35 cP.

19. The dispersion of a conductive carbon material of claim 11, wherein the dispersion of the conductive carbon material shows no settling after at least 45 days.

* * * * *